US006457758B1

(12) United States Patent
Gerdes

(10) Patent No.: US 6,457,758 B1
(45) Date of Patent: Oct. 1, 2002

(54) MECHANICAL LITTER STICK

(76) Inventor: K. Eric Gerdes, 4660 S. Hwy ZZ, Republic, MO (US) 65738

( * ) Notice: Subject to any disclaimer, the term of this patent is extended or adjusted under 35 U.S.C. 154(b) by 0 days.

(21) Appl. No.: 10/041,153

(22) Filed: Jan. 8, 2002

Related U.S. Application Data

(60) Provisional application No. 60/260,612, filed on Jan. 9, 2001.

(51) Int. Cl.[7] ..... A01D 9/06; E01H 1/12

(52) U.S. Cl. ..... 294/61; 294/24

(58) Field of Search ..... 294/19.1, 19.3, 294/24, 26, 50.5, 50.6, 50.8, 50.9, 103.1, 104, 61; 43/6

(56) References Cited

U.S. PATENT DOCUMENTS

| | | | | | |
|---|---|---|---|---|---|
| 2,228,690 | A | * | 1/1941 | Crary | 294/61 |
| 2,794,667 | A | * | 6/1957 | Bissitt | 294/61 X |
| 2,852,298 | A | * | 9/1958 | Tunstall | 294/61 |
| 2,989,334 | A | * | 6/1961 | Browne | 294/61 X |
| 3,105,715 | A | * | 10/1963 | Happ | 294/61 |
| 3,183,031 | A | * | 5/1965 | Haberstick | 294/61 X |
| 3,526,424 | A | * | 9/1970 | Torres | 294/24 |

* cited by examiner

*Primary Examiner*—Johnny D. Cherry
(74) *Attorney, Agent, or Firm*—Jonathan A. Bay

(57) ABSTRACT

A mechanical litter stick is provided with a mechanism for cycling an operative pick through a given back-and-forth stroke both for stripping litter off a spike end as well as affording better manipulation of articles of litter as by plucking.

20 Claims, 6 Drawing Sheets

2
14
40
42
56
44

12
58
10
26
24
30
22
20
2

10
58
12
64
20
26
24
22
30

10
58
12
26
24
22
30
20

10
12
58
64
20
26
24
22
30

MECHANICAL LITTER STICK

CROSS-REFERENCE TO PROVISIONAL APPLICATION(S)

This application claims the benefit of U.S. Provisional Application No. 60/260,612, filed Jan. 9, 2001.

BACKGROUND AND SUMMARY OF THE INVENTION

The invention relates to litter sticks and more particularly to a mechanical litter stick provided with a mechanism for cycling an operative pick through a given back-and-forth stroke both for stripping litter off a spike end as well as, in the alternative, affording better manipulation of articles of litter as by plucking or the like.

A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
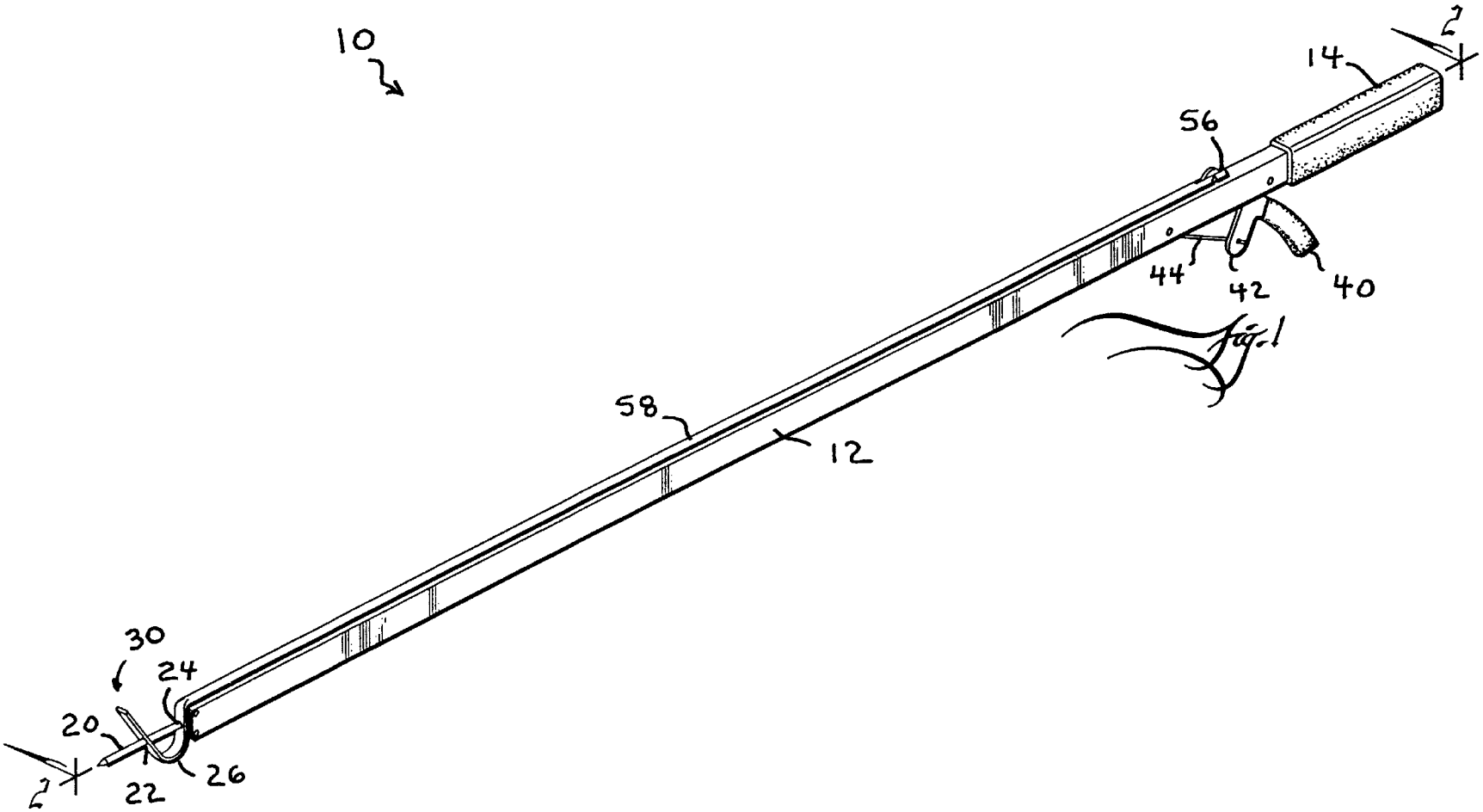
FIG. 1 is a perspective view of a mechanical litter stick in accordance with the invention.

FIG. 1 illustrates a mechanical litter stick 10 in accordance with the invention. The inventive litter stick 10 includes a main staff 12 extending between an upper hand-stock 14 portion and a lower bracket end from which projects a pointed spike 20. The spike 20 extends through a pair of slide-holes 22 and 24 for it in the lower recurve portions 26 of an S-form pick 30. The pick 30 terminates in a tip end for picking and/or plucking up litter as will be disclosed more particularly below in connection with FIGS. 7 and 8. The upper hand-stock portion 14 is covered by a resilient sleeve for better grip by a user/operator. At the lower margin of the gripping sleeve, the main staff carries a trigger 40 (or in alternative terms, an 'operator's lever') which is also covered in part by a resilient sleeve for better traction.

Figure 2:
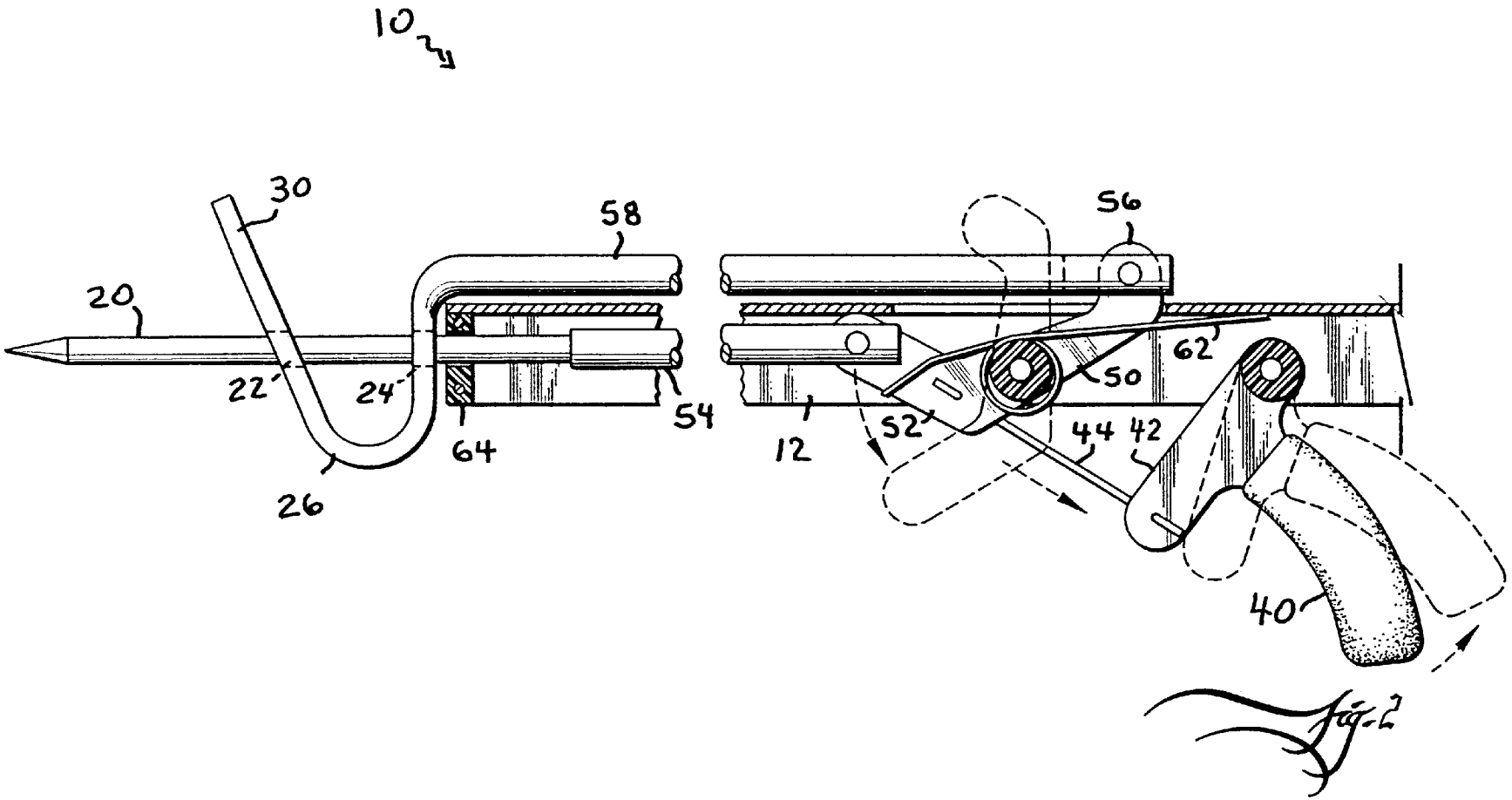
FIG. 2 is an enlarged scale sectional view taken along line 2—2 in FIG. 1 and with intermediate as well as right-end portions broken away, wherein the trigger as depicted in solid lines shows an extreme slack position therefor while as depicted in dashed lines shows the trigger in an intermediate squeezed position.

FIG. 2 provides a sectional view taken along line 2—2 in FIG. 1 and in which intermediate as well as upper or hand-stock end portions are broken away. The main staff 12 preferably comprises aluminum channel stock or the like. The channel of the main staff 12 provides for the inset and/or mounting of components as will be more particularly described below. The trigger 40 or 'operator's lever' more particularly comprises the stem portion of a T-shaped crank 42. One end of the crank 42 pivots about a pin. Attachment of the pin is achieved by extending the pin between the opposite flanges of the main staff 12's channel stock. The pin ends may be mushroomed as in a rivet-style to fix the pin. To return to the crank 40, it extends from its pinned end to an output end which is connected to a connecting link 44. Again, the trigger 40 extends or 'Tees' off the crank 42 intermediate its pinned and output ends. The connecting link 44 rocks a rocker 50.

The rocker 50 is mounted on another pin that spans between the opposite flanges of the main staff 12's channel stock as comparably as described above. The rocker 50 comprises a pair of crooked legs 52 and 56. An inboard one 52 of the crooked legs is connected to an inboard shaft 54 that terminates in a connection with the pointed spike 20. The other crooked leg 56 is connected to an outboard shaft 58 that terminates in the S-form pick 30. The inboard or spike shaft 52 predominantly lies within the confines of the main staff 12's channel stock. The outboard or pick shaft 58 predominantly extends along the outside of the channel 12's web. The connecting link 44 attaches to the rocker 50 on the inboard leg 52 at some spacing from the rocker 50's pivot axis to gain a moment arm on the rocker 50. The spike and pick shafts 54 and 58 preferably comprise tube stock such as stiffened aluminum tube or the like. The shafts 54 and 58 and rocker legs 52 and 56 can be connected by clevis and pin arrangements as is known in the art.

The majority of materials used to fabricate the mechanical litter stick 10 can be chosen from any appropriate stock material although to date aluminum is preferred for most of the parts. For some parts though, it is preferred if plastic bushings are used to flank and shield the crank 42 and rocker 50 from the flanges of the channel stock 12. Also, the connecting link 44 can be formed from a suitable steel wire. Moreover, as the rocker 50 is biased in a given direction— ie., as in the extreme clockwise position as shown by FIG. 2—by a torsion spring 62, such torsion spring 62 is preferably fashioned from spring steel.

Whereas the drawings show the S-form pick structure 30 formed directly in one end of an aluminum tube (eg., outboard shaft 58), it is preferable if the S-form pick structure 30 is produced by any optional means which comparably achieves the functions of the structure as shown. For example and without limitation, the S-form pick structure 30 may optionally be produced as a distinctly different piece which is later assembled onto the blank end of a straight rod or tube (eg., like shaft 58, though this is not shown). Such a distinctly separate pick head (eg., formed like pick 30, though this is not shown) can be affixed to the end of a straight rod or tube (eg., like shaft 58) by a suitable connection, as for example a telescoping pin which inserts inside the open blank end of a hollow tube. That way, the S-form of the pick structure 30 can be produced in a material different from the aluminum stock of the straight rod or tube 58, like some alloy of aluminum or the like which although slightly more costly may also be more amenable to being formed into shape without stress fractures and so on. For example, more particularly, such a separate pick head may be produced from a casting of aluminum alloy, including without limitation Al-Mag 35 or the like.

The inboard ('spike') and outboard ('pick') shafts 54 and 58 are substantially slender and elongated, which is not as evident in FIG. 2 as it is in FIG. 1. With reference to FIG. 1, the outboard or 'pick'shaft 58 lies on the outside of the channel 12 as shown between its clevis connection with the rocker 50 and its S-form pick end 30. To return to FIG. 2, the inboard or 'spike'shaft 54 is comparably slender (although not in view in FIG. 1). The spike end 20 is preferably a sharpened steel rod which gets press fitted into the open end of the spike shaft 54. The main staff 12's bracket end holds a plastic bracket 64 which is formed with a slide hole in it for the reversible travel of the spike 20 as shown more particularly in comparing among FIGS. 2, 3 and 4.

Figure 3:
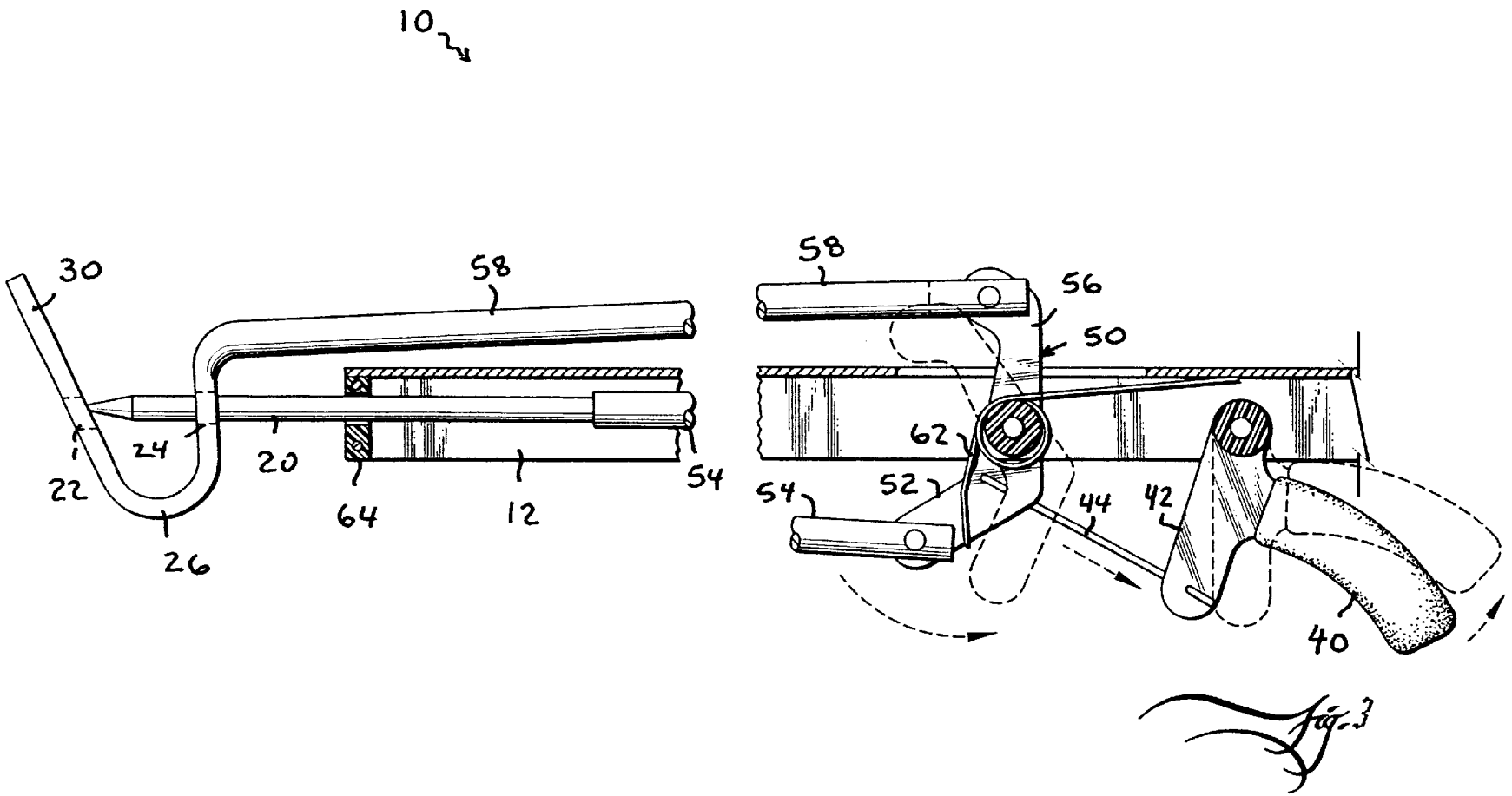
FIG. 3 is a sectional view comparable to FIG. 2 except showing continuation of the action sequence thereof wherein the trigger as depicted in solid lines shows the dashed-line intermediate-position of FIG. 2 so that the corresponding depiction in solid lines in this FIG. 3 of the spike and an S-form pick show their relatively intermediate activated positions in reaction to the intermediate-position drive input from the trigger, while in this same FIG. 3 the trigger as depicted in dashed lines shows the trigger in an extreme squeezed position.

In FIGS. 2 and 3, the trigger/crank 40 and the rocker 50 are depicted prominently in solid lines but are also depicted in dashed lines. With particular reference to FIG. 2, the trigger/crank 40 is depicted in solid lines in an extreme slack or de-activated position. The rocker 50 is likewise shown in an extreme de-activated position, which for it is also an extreme clockwise position given the viewpoint of FIG. 2. The rocker 50's further clockwise travel as induced by the unwinding of the torsion spring 62 is stopped by the inboard leg 52 contacting against the web of the main staff 12's channel stock. In sum, the solid outlines of the trigger/crank 40 and rocker 50 show their positions in the absence of any applied input movement to the trigger 40.

The dashed outlines in FIG. 2 of the trigger/crank 40 and rocker 50 show a changed position, one in which results from an intermediate applied input to the trigger 40. Most usually, an intermediate applied input is produced by the partial squeezing of the trigger 40 by the user/operator. That is, in use the user/operator predominantly manipulates the litter stick 10 by a firm grip on the hand-stock 14. However, the user/operator is afforded the option of extending one, two or three fingers or so over the trigger 40 to alternately squeeze and relax the trigger 40. Operating the trigger 40 operates the mechanical actions of the inventive litter stick 10 as more particularly described below.

To refer next to FIG. 3, it is comparable to FIG. 2 except it shows a continuation of the action sequence begun by FIG. 2. That is, the trigger 40 as depicted in FIG. 3 in solid lines corresponds to the dashed-line. intermediate-position of FIG. 2. The corresponding depiction in solid lines in FIG. 3 of the spike 20 and pick 30 show their relatively opposite travel to their own respective intermediate positions to which they go in reaction to the drive input from the trigger 40. That is, squeezing the trigger 40 from its slack position (solid lines in FIG. 2) to an intermediate position (eg., solid lines in FIG. 3) causes the following:—(i) upward rotation of the rocker 50's inboard leg 52 to pull the spike 20 in a retraction stroke, as well as (ii) downward rotation of the rocker 50's outboard leg 56 to drive the pick 30 in extension. FIG. 3 shows that the spike point 20 is retracted to about even with if not slightly withdrawn in the outermost slide hole 22 for it in the S-form pick 30. To turn to FIGS. 5 and 6, these views show one example utility for such action.

Figures 5, 6:
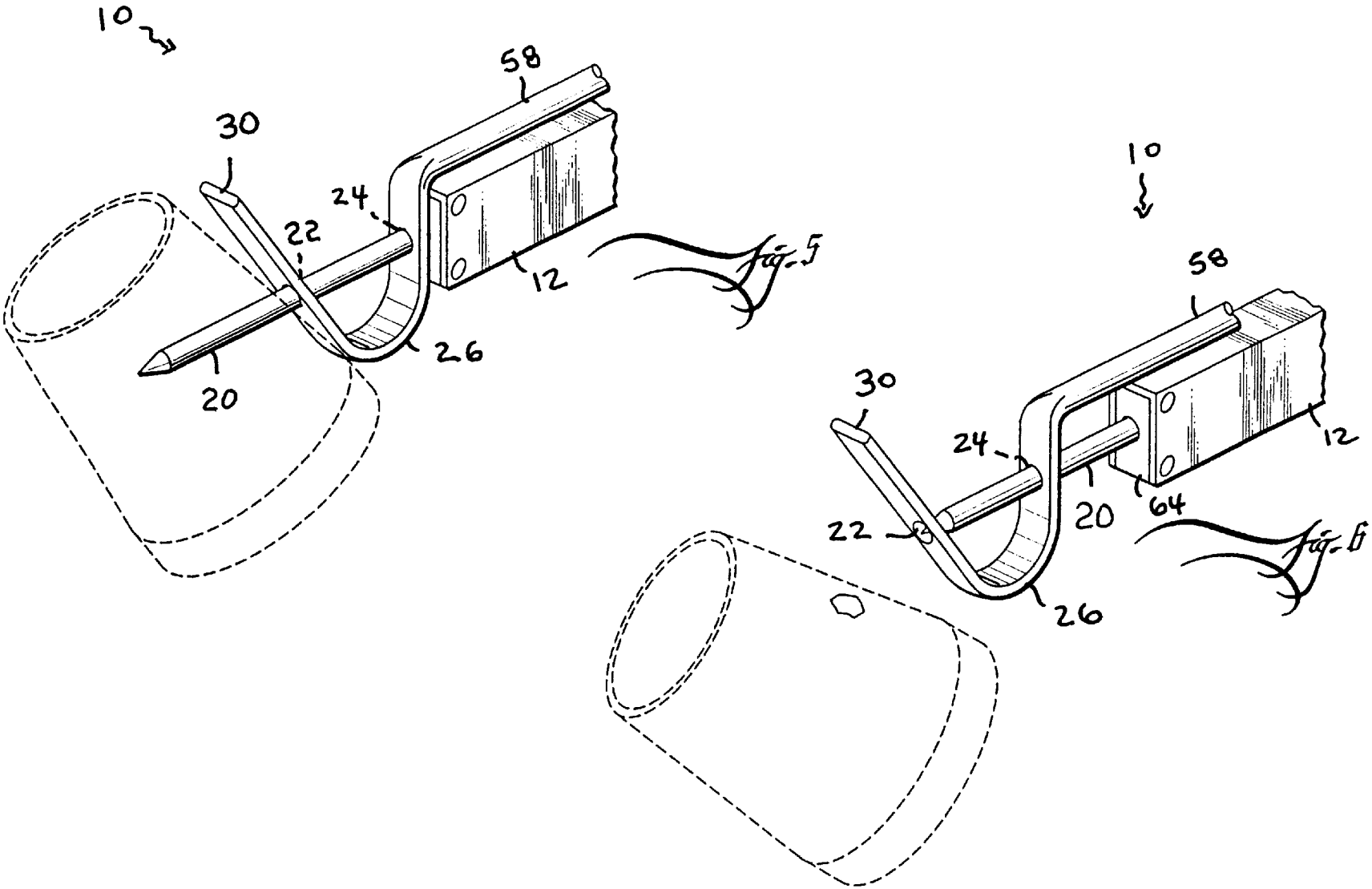
FIG. 5 is an enlarged scale perspective view of the spike end of the litter stick, with the up-staff portions broken away, wherein the spike is depicted impaling an article of litter to show one operative use thereof.
FIG. 6 is a perspective view comparable to FIG. 5 except depicting the spike relatively retracted as the S-form pick is relatively extended to show how the impaled article of litter is wiped or stripped off thereby.

FIG. 5 shows the spike 20 and pick 30 in their positions at the absence-of-input movement from the trigger 40. That is, the spike 20 is fully extended as the pick 30 is fully retracted. Those relative positions give the spike 20 its greatest free extension beyond the pick 30's outer- or lowermost slide hole 22. That puts the spike 20 in a preferred use position for impaling articles of litter as shown in FIG. 5. In corresponding FIG. 6, it shows that the cooperative spike-retraction and pick-extension gotten simultaneously by squeezing the trigger 40 to an intermediate position causes the pick 30 to wipe the spike 20 clean, or in alternative phraseology, strip the litter off the spike 20. Accordingly, FIG. 6 shows the article of litter wiped off loose from the spike 20 and let to fall after that. Again, getting the spike 20 and pick 30 to move from the FIG. 5 position to the FIG. 6 position is achieved by partly squeezing the trigger 40 (not shown) from its extreme slack position to a corresponding intermediate position.

Returning to FIG. 3 the trigger/crank 40 and rocker 50 are depicted in dashed lines to show their extreme activated positions. To refer forward to FIG. 4, it is comparable to FIG. 3 except it shows a further continuation of the action sequences begun by FIGS. 2 and 3.

Figure 4:
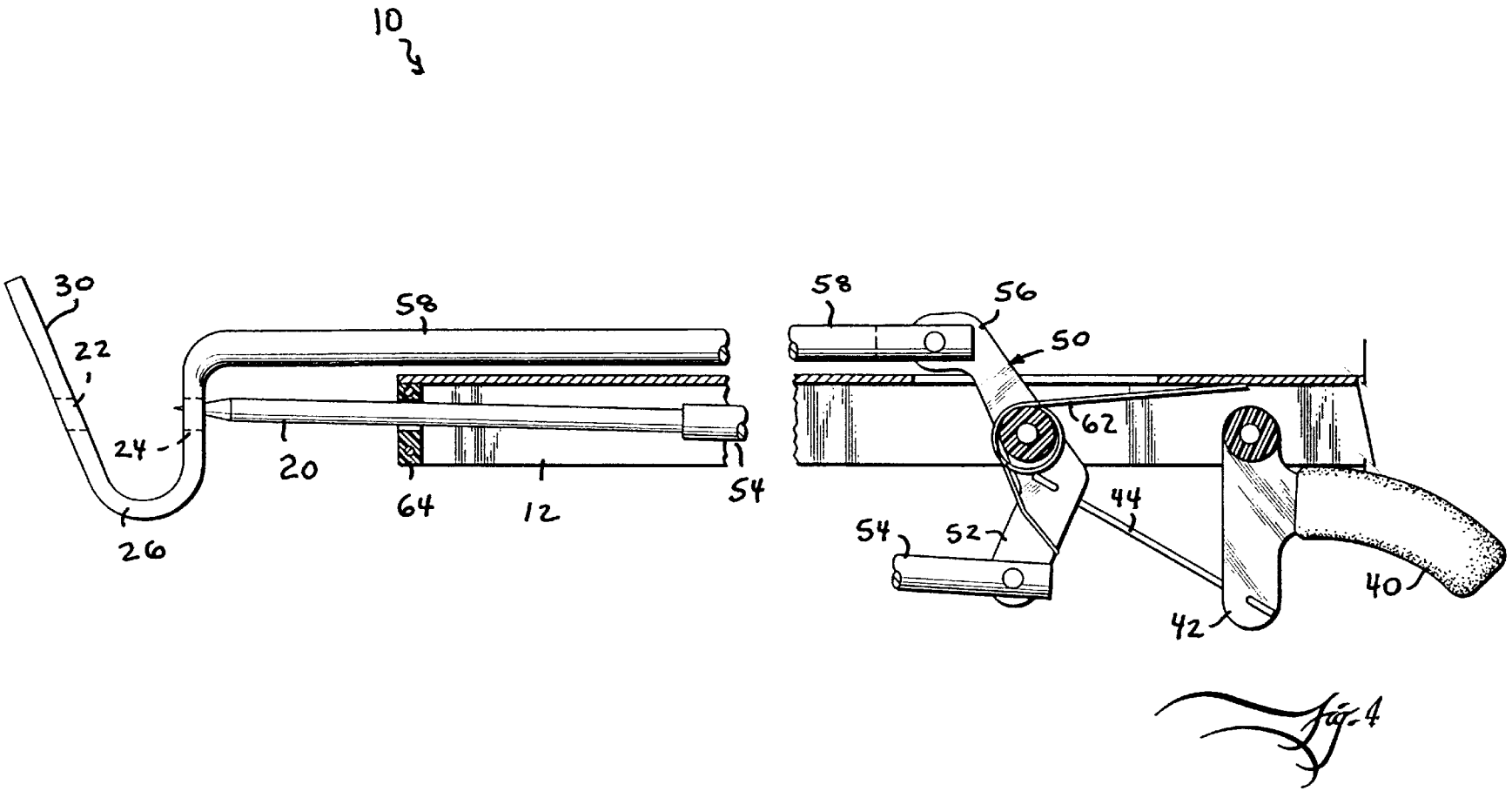
FIG. 4 is a sectional view comparable to FIGS. 2 and 3 and showing further continuation of the action sequences thereof wherein the trigger as depicted in solid lines shows the dashed-line extreme-position of FIG. 3 so that the corresponding depiction in solid lines in this FIG. 4 of the spike and S-form pick show their relatively extreme activated positions, given their opposite directions of travel, and in reaction to the further drive input from the trigger.

In FIG. 4, the trigger/crank 40 and rocker 50 are only depicted in solid lines and in positions which correspond to the extreme-activated positions shown by dashed-lines in FIG. 3. The corresponding depiction in FIG. 4 of the spike 20 and pick 30 shows their extreme activated positions. Since the spike 20 and pick 30 are driven in opposite directions at the same time, the spike 20 is shown in an extreme retracted position as the pick 30 in an extreme extended position. The spike point 20 travels to about even with the inner- or uppermost slide hole 24 for it in the lower recurve portion 26 of the S-form pick 30.

FIG. 4 shows that the trigger/crank 40 has pulled the connecting link 44 with the rocker 50 onto nearly a direct line with or a diameter of the rocker 50's pivot axis. In other words, there is no further travel to be gotten by pulling on the connecting link 44. Thus, FIG. 4 shows the connecting link 44 pulled out so straight as to lie on a diameter of the rocker 50's axis and hence lose its angle-of-attack or moment arm on the rocker 50.

With attention to the spike point 20, the spike point 20 is scaled relative to the innermost slide hole 24 of the pick 30 so as to not quite withdraw clear and free of the last slide hole 24. If the spike point 20 could get by the last slide hole 24, then the pick shaft 58 would be free to flop about loosely around its clevis attachment with the rocker 50 (see, eg., FIG. 1). And if that were to happen, the user would have to re-thread the spike 20 through the slide holes 22 and 24 for it in the pick 30 to get the litter stick 10 back into its preferred condition. Hence the spike 20's and pick 30's relative strokes are designed so as to keep the spike 20 inserted through at least the last slide hole 24 for it in the pick 30, even at their activated extremes.

Figures 7, 8:
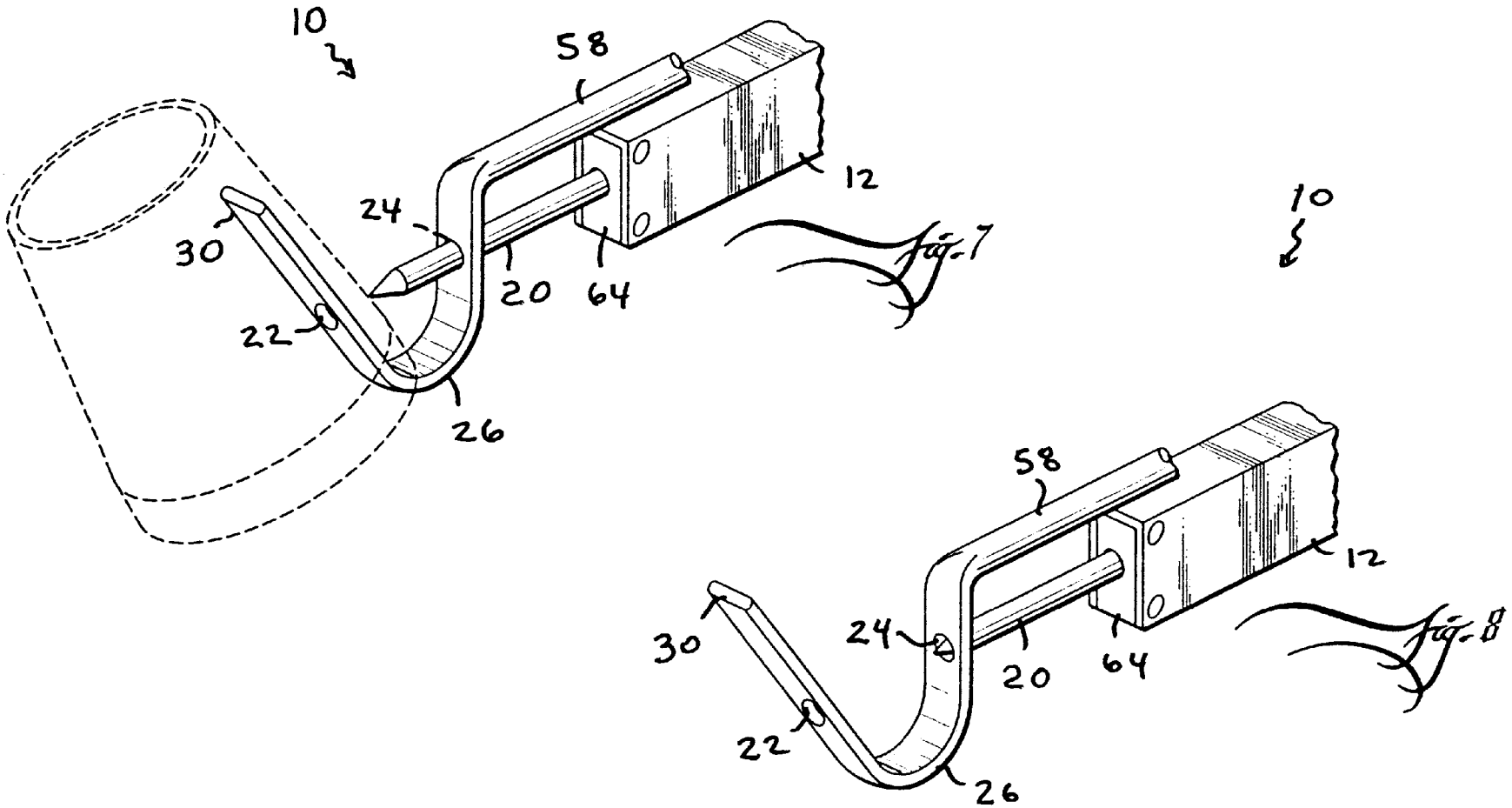
FIG. 7 is a perspective view comparable to FIG. 6 except showing the spike and pick traveled to further opposite states of retraction and extension respectively to afford use of the pick to pluck up an article of litter as shown, wherein the spike has been allowed to drive back down onto and hence pinch the article of litter as shown; and, FIG. 8 is a perspective view comparable to FIG. 7 except showing the opposite extremes spike-retraction and pick-extension to effect release of the article of litter.

To turn to FIGS. 7 and 8, they show one example utility for the further action of the spike 20 and pick 30 that is produced by the changing positions between FIGS. 3 and 4. FIG. 8 shows the spike 20 fully retracted and the pick 30 fully extended, and those relative positions give the lower recurve portion 26 of the pick 30 the greatest clearance of the spike 20. That affords the pick 30 its advantageous utility to pick or pry at litter and thereafter pick or pluck it up in the manner shown in FIG. 7. Indeed, FIG. 7 shows the pick 30 inserted inside the mouth of a cup as well as the spike 20 let back down to the extent of pinching on the outside of the cup. This improves the holding power on the cup. If given the position of things in FIG. 7, and then moving things to the position as shown by FIG. 8 where the spike 20 retracts and the pick 30 extends, this ultimately has the spike 20 releasing its pinch on the article of litter (eg., the cup). The cup is free to fall away. Indeed, if the cup in FIG. 7 were to be impaled by the spike 20, then FIG. 8 shows that the pick 30 would wipe the spike 20 clean here too as was disclosed comparably in connection with FIG. 6.

Referring back to FIGS. 7 and 8, achieving the fullest combined spike-retraction and pick-extension as shown in FIG. 8 is gotten by the user squeezing the trigger 40 to its activated extreme as shown by FIG. 4. Reversing the combined extreme spike-retraction and pick-extension of FIG. 8 to an intermediate position as shown by FIG. 7 is gotten by slackening the trigger 40 to an intermediate position such as approximately shown in solid lines in FIG. 3. Then to go back once more to the fullest spike-retraction and pick-extension of FIG. 8 is gotten by activating or squeezing the trigger 40 to the extreme activated position shown by FIG. 4. And so on, endlessly, allowing a user to pick and pluck litter at will and then release to deposit it in whatever container.

In brief sum, FIGS. 5 and 6 show successively an inventive impale and then strip mode of use of the inventive mechanical litter stick 10. FIGS. 7 and 8 show successively an inventive pluck and pinch and then release or strip mode of use of the inventive mechanical litter stick 10.

Further aspects of the pick structure 30 relate to the following. The pick structure 30 is highly advantageous for inserting inside the mouths of drink cans and bottles as water, soft drinks and/or beer are commonly sold in. Such drink cans and bottles unfortunately constitute as significant source of litter and to date have defied easy pick up and/or plucking by conventional litter sticks. It is thus another object of the invention, in addition to the many others mentioned previously, to provide a litter stick advantageously designed for plucking and retention of such drink cans or bottles.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A mechanical litter stick comprising:

a main staff having an upper hand-stock portion for operator handling and extending axially to a lower spike comprising a shank having a sharp tip;

a mechanism attached to the main staff having an actuator in the proximity of the hand-stock portion facilitating concurrent one-handed staff-handling and actuator-actuation, said mechanism further having first and second output ends and being operative such that actuation of the actuator produces corresponding movement of the output ends between respective activated and de-activated states;

a wiper structure disposed in a wiping arrangement with the spike shank whereby relative movement between the spike shank and the wiper structure can produce a wiping effect to push off debris previously impaled and otherwise stuck on the spike;

first and second drive shafts having origins linked respectively to the mechanism's first and second output ends and extending to terminations which for the first drive shaft is characterized by the spike and for the second drive shaft the wiper structure, wherein the drive shafts are supported relative to the main staff for opposite extension and retraction strokes whereby mechanism actuation from the de-activated state to a given actuated state produces extension of the wiper structure concurrently with retraction of the spike and thereby the relative movement between the spike shank and wiper structure that produces the wiping effect.

2. The mechanical litter stick of claim 1 wherein said mechanism comprises a rocker mounted about a rocking axis and the first and second output ends comprise angularly spaced points spaced away from the rocking axis.

3. The mechanical litter stick of claim 2 further comprising a torsion spring biasing the rocker such that in the absence of an applied force as input through the actuator, the torsion spring biases the mechanism in the extreme de-activated state, and which opposes any force applied through the actuator as well as restores the mechanism to the extreme de-activated state with the removal of such applied force.

4. The mechanical litter stick of claim 1 wherein the wiping structure comprises the second drive shaft having an apertured foot connected in a sliding engagement with the spike shank.

5. The mechanical litter stick of claim 4 wherein the foot projects substantially to a pick end that has an angle-of-attack divergent from the axial extension of the main shaft and which facilitates plucking operations.

6. The mechanical litter stick of claim 1 wherein the first drive shaft is supported relative to the main staff by an apertured bracket affixed to the main staff which provides sliding support for the first drive shaft, and wherein said second drive shaft has an apertured foot connected in a sliding engagement with the spike shank and thereby gains sliding support off the first drive shaft.

7. A mechanical litter stick comprising:

a main staff having a handle end and an opposite end provided with an operative combination of a spike and a clamping pick;

a lever-operated mechanism for cycling the spike and pick in opposite directions and having a lever disposed relative to the handle to facilitate one-handed staff-handling and lever-operation;

wherein said spike terminates in a sharp tip and extends back therefrom along a shank that extends generally parallel with the main staff to connect up with the mechanism;

wherein said pick terminates in a lower pick tip having an angle-of-attack generally divergent relative to the main staff and extends back therefrom along a re-curve portion changing to an upper axial portion that extends generally parallel with the main staff to connect up with the mechanism differently from the spike shank;

said re-curve portion having a lower apertured section for wiping and an upper apertured section for guiding, wherein the apertures thereof align for concurrent through-sliding of the spike shank, wherein said wiping section is disposed such that relative axial movement between the spike and pick can produce a wiping effect to push off debris previously impaled and otherwise stuck on the spike, and wherein said guiding section is disposed such that a guiding effect is achieved so if the spike tip has retracted out of the aperture of the wiping section then the re-entry of the spike tip is guided thereby;

said mechanism being operative to drive the spike and pick concurrently in opposite directions such that partial retraction of the spike tip relative to partial extension of the wiping section produces the wiping effect, while further retraction of the spike tip to form a gap with the wiping section allows release of the spike tip in reverse toward the wiping section which thus achieves a clamping action as by releasably clamping on an article of debris between said spike tip and wiping section.

8. The mechanical litter stick of claim 7 wherein said mechanism comprises a rocker mounted about a rocking axis and having first and second legs for concurrently pushing and pulling, or vice versa, the spike and pick in opposite directions whereby the rocker amplifies the relative displacement between the spike and pick as compared to the unamplified displacement of the spike or pick alone in relation to the main staff.

9. The mechanical litter stick of claim 8 further comprising a torsion spring biasing the rocker such that in the absence of an applied force as input through the lever, the torsion spring biases the mechanism to push the spike in an extreme state of extension concurrently with the pick pulled to an extreme state of retraction, and which torsion spring opposes any force applied through the lever as well as restores the mechanism to the state characterized by the absence of such force.

10. The mechanical litter stick of claim 9 wherein the lever is pivoted to the main staff about a pivot axis spaced away from the rocking axis, and further comprising a connecting link extending between said rocker and lever.

11. The mechanical litter stick of claim 10 wherein said link is connected such that a given angular input to the lever produces an amplified angular output with the rocker.

12. The mechanical litter stick of claim 11 wherein said lever comprises a trigger whereby an operator can operate the trigger with one, two or three fingers.

13. The mechanical litter stick of claim 7 wherein the main staff generally comprises a channel form such that the spike shank lies generally within the confines of the channel form as the pick's upper axial portion lies generally without.

14. A mechanical litter stick comprising:

a main staff having an upper hand-stock portion for operator handling and extending axially to a lower spike and pick combination;

a mechanism attached to the main staff having an actuator in the proximity of the hand-stock portion facilitating concurrent one-handed staff-handling and actuator-actuation, said mechanism further having first and second output ends wherein actuation of said actuator produces corresponding movement of the output ends between respective activated and de-activated states;

wherein said spike terminates in a sharp tip and extends back therefrom along a shank that extends generally axially parallel to the main staff to connect up with the mechanism's first output end;

wherein the pick comprises a shaped form that terminates in a lower pick end having an angle-of-attack generally divergent from the axially-extending main staff and extends back therefrom along a re-curve portion changing to an upper axial portion that extends generally axially parallel to the main staff to connect up with the mechanism's second output end;

said re-curve portion having a lower apertured section formed with a hole for wiping and an upper apertured section formed with a hole for guiding wherein said holes are generally aligned for concurrent extension therethrough of the spike shank;

said wiping hole being disposed in a wiping arrangement with the spike shank whereby relative axial movement between the spike shank and the wiping hole can produce a wiping effect to push off debris previously impaled and otherwise stuck on the spike;

said guiding hole being disposed in a guiding arrangement with the spike shank whereby relative axial movement between the spike shank and the guiding hole produces a guiding effect so that if the spike tip has retracted out of the wiping hole then the guide hole can guide the re-entry thereof through the wiping hole;

wherein actuation of said mechanism from the de-activated state to an intermediate actuated state produces extension of the wiping hole concurrently with retraction of the spike and thereby the relative movement between the spike shank and wiping hole that produces the wiping effect, with further actuation of said mechanism reversibly between the intermediate actuated state and a more extreme state of actuation further effects retraction of the spike tip out of the wiping hole and then in reverse the guided re-entry of said spike tip whereby an article of debris can be releasably clamped between the spike tip and the pick's lower apertured section.

15. The mechanical litter stick of claim 14 further comprising a torsion spring biasing the mechanism such that in the absence of an applied force as input through the actuator, the torsion spring biases the mechanism in the extreme de-activated state, and which opposes any force applied through the actuator as well as restores the mechanism to the extreme de-activated state with the removal of such force.

16. The mechanical litter stick of claim 14 wherein said mechanism comprises a rocker mounted about a rocking axis such that the first and second output ends concurrently push and pull, or vice versa, the spike and pick in opposite directions whereby the rocker amplifies the relative displacement between the spike and pick as compared to the unamplified displacement of the spike or pick alone in relation to the main staff.

17. The mechanical litter stick of claim 16 wherein the actuator is pivoted to the main staff about a pivot axis and has a pivoting motion between opposite extremes, wherein said pivot axis is spaced away from the rocking axis, said mechanical litter stick further comprising a connecting link extending between said rocker and actuator wherein said link is connected such that a given angular input to the actuator produces an amplified angular output with the rocker.

18. The mechanical litter stick of claim 14 wherein the spike's shank is supported relative to the main staff by an apertured bracket affixed to the main staff at a position substantially spaced lower than the upper hand-stock portion, said apertured bracket thereby providing sliding support for the spike's shank.

19. The mechanical litter stick of claim 18 wherein said guiding arrangement between the spike shank and guiding hole has the bracket-supported spike shank providing sliding support for the pick.

20. The mechanical litter stick of claim 14 wherein the main staff is generally hollow or semi-hollow and either the spike shank or pick's upper axial portion extends generally within as the other extends generally without.

* * * * *